US005095858A

United States Patent [19]

Ascari

[11] Patent Number: 5,095,858

[45] Date of Patent: Mar. 17, 1992

[54] TIMING SYSTEM, PARTICULARLY FOR AN INTERNAL COMBUSTION ENGINE WITH A NUMBER OF VALVES PER CYLINDER

[75] Inventor: Ennio Ascari, Formigine, Italy

[73] Assignee: Ferrari S.p.A., Via Emilia Est, Italy

[21] Appl. No.: 717,414

[22] Filed: Jun. 17, 1991

[30] Foreign Application Priority Data

Jun. 19, 1990 [IT] Italy ..... 67-449 A/90

[51] Int. Cl.[5] ..... F01L 1/04

[52] U.S. Cl. ..... 123/90.27; 123/308

[58] Field of Search ..... 123/90.16, 90.27, 308

[56] References Cited

U.S. PATENT DOCUMENTS

| | | | |
|---|---|---|---|
| 4,660,529 | 4/1987 | Yoshikawa | 123/90.27 |
| 4,697,554 | 10/1987 | Bothwell | 123/90.27 |
| 4,911,113 | 3/1990 | Yamada | 123/90.27 |
| 4,979,474 | 12/1990 | Morishita | 123/90.27 |
| 5,018,497 | 5/1991 | Tsuchida | 123/90.27 |

*Primary Examiner*—E. Rollins Cross

*Assistant Examiner*—Weilun Lo

*Attorney, Agent, or Firm*—Shlesinger Arkwright & Garvey

[57] ABSTRACT

A timing system for controlling, by means of a single overhead camshaft, three adjacent, homologous valves of an internal combustion engine cylinder; each valve having a tappet located between the valve stem and a respective control cam on the camshaft. The valve stems are arranged with their axes shifted laterally, and alternately on opposite sides, in relation to a plane including the axes of the tappets, so as to define a first eccentricity between each valve stem and respective tappet in a plane perpendicular to the camshaft axis. The intermediate valve item is aligned with the axis of the respective tappet in the first plane. In a plane perpendicular to the above plane the other two valve stems are both shifted laterally towards the intermediate valve stem, so as to define, with the respective tappets, a second eccentricity perpendicular to the first. The tappets may thus be arranged side by side and aligned centrally along the camshaft axis.

8 Claims, 8 Drawing Sheets

TIMING SYSTEM, PARTICULARLY FOR AN INTERNAL COMBUSTION ENGINE WITH A NUMBER OF VALVES PER CYLINDER

BACKGROUND OF THE INVENTION

The present invention relates to a timing system for regulating, via respective camshaft-controlled valves, fluid input or output to/from a number of cylinders of an engine and/or machine. In particular, the present invention relates to an overhead camshaft timing system for an internal combustion engine featuring a number of valves, e.g. five, per cylinder.

To improve the volumetric efficiency of internal combustion engines, particularly high-performance engines of sports cars or so-called touring cars, the common design practice is to provide timing systems which, instead of the usual two valves (supply and exhaust) per cylinder, feature for example four (two supply and two exhaust) or five (three supply and two exhaust) valves per cylinder. The latter type in particular involves serious design problems in terms of valve control and/or arrangement of the valves to prevent interference, particularly between the tappets of the three supply valves. To overcome this problem, U.S. Pat. No. 4,615,309 provides for a spread arrangement of the supply valves, the middle one being arranged obliquely in relation to the two lateral valves, thus enabling all three to be controlled by a single camshaft, and for using targets with smaller than normal diameter caps, in the example shown, smaller than the caps on the exhaust valves.

Such a solution, however, still involves a number of drawbacks. Foremost of these is that the small diameter caps, particularly in the presence of valves inclined in relation to the camshaft, and therefore in the presence of possible lateral thrust on the tappets, may result in increased contact pressure between the caps and the cap guides on the cylinder head, thus resulting in impairment of the lubricating oil film and/or greater wear on moving parts.

SUMMARY OF THE INVENTION

The aim of the present invention is to provide a timing system, particularly for high-performance internal combustion engines, designed to overcome the aforementioned drawbacks, i.e. which is straightforward to produce and does not necessarily require the use of valves inclined in relation to the cylinder axis.

With this aim in view, according to the present invention, there is provided a timing system, particularly for an internal combustion engine, whereby a camshaft controls, against the action of elastic means, the translation of respective stems an intermediate valve and two adjacent lateral service valves, for regulating the input or output of a fluid from a respective cylinder; each said valve being controlled by a respective cam of said camshaft via the interposition of a respective tappet; characterised by the fact that the tappets are arranged with their axes shifted laterally, and alternately on opposite sides, in relation to the axes of the respective valve stems, so as to define, between each valve stem and respective tappet, a first eccentricity in a first plane perpendicular to the axis of the camshaft; in a second plane perpendicular to said first plane, the stem of said intermediate valve being aligned with the axis of the respective tappet, whereas the stems of the other two valves are both shifted laterally in relation to the axis of the respective tappet and towards the stem of said intermediate valve, so as to define, between the same and the respective tappets, a second eccentricity perpendicular to said first eccentricity.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
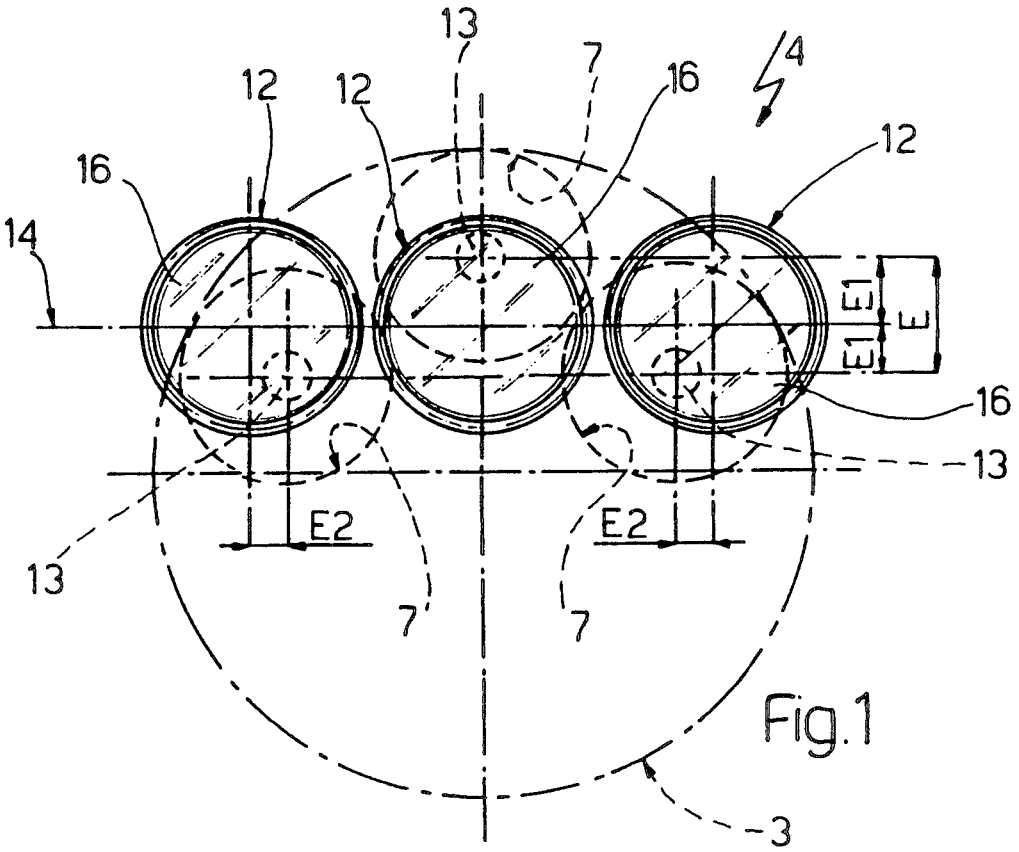
FIGS. 1 and 2 show two top plan views, at different levels, of a timing system in accordance with the present invention.
Figure 2:
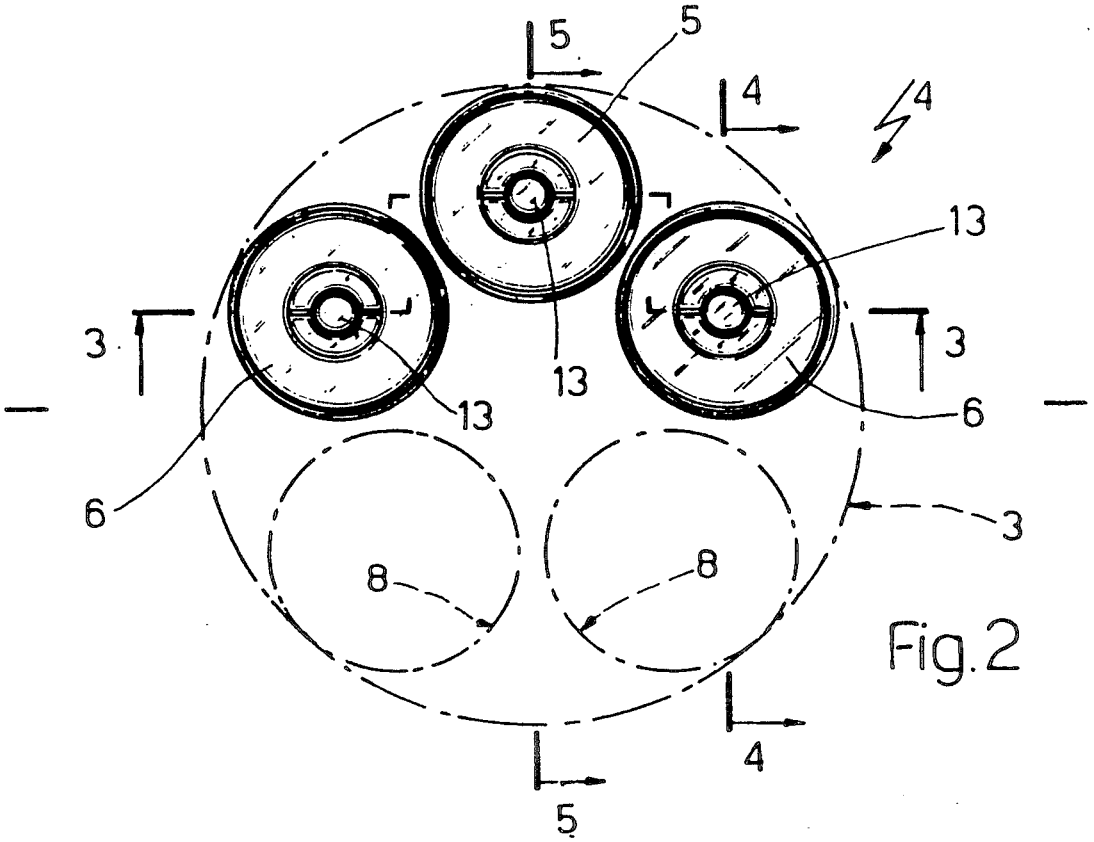

Number 1 in FIGS. 1 to 5 indicates a known internal combustion engine of which is illustrated, for the sake of simplicity, only the top portion comprising a cylinder head 2 and, underneath, a single cylinder 3 defining, together with cylinder head 2, one of the combustion chambers of engine 1. The other combustion chambers defined by the other cylinders 3 of engine 1 are identical and therefore not shown. Engine 1 presents a timing system indicated as a whole by 4 and comprising, in the non-limiting example shown, five service valves for each cylinder 3: three adjacent supply valves consisting of an intermediate valve 5 and two opposite lateral valves 6; and two adjacent known exhaust valves (not shown). All the above valves are mushroom types for opening/closing respective intake ports 7 and exhaust ports 8 of cylinder 3, with which they are coaxial. Said ports are formed in a ring on cylinder head 2, on top of the combustion chamber defined by cylinder head 2 and respective cylinder 3, and are arranged substantially in the form of a pentagon.

Timing system 4 also comprises a respective camshaft 10 for simultaneously controlling all the valves 5 and 6 of all the cylinders 3 on engine 1; and a similar known camshaft (not shown) for controlling (in known manner not shown) the valves of exhaust ports 8 of all the cylinders 3 on engine 1. According to a variation not shown, the exhaust ports may also be three in number like the intake ports, to give an engine with six valves per cylinder (e.g. wherein the six ports are arranged in the form of a hexagon on top of the combustion chamber), in which case, the three exhaust valves are controlled in exactly the same way as valves 5 and 6 described hereinafter, which therefore also applies to control of the exhaust valves if these are three in number like valves 5 and 6.

For each valve 5 and 6, shaft 10 comprises a respective control cam 11 of predetermined shape, for controlling translation of a respective valve stem 13 via the interposition of a respective known tappet 12 and against the action of respective elastic means 15. According to the non-limiting example shown, timing system 4 according to the present invention presents an overhead camshaft arrangement, i.e. wherein cams 11 of camshaft 10 cooperate directly with tappets 12, camshaft 10 being arranged so as to turn about an axis 14 (FIGS. 1 and 3) along which tappets 12 are arranged side by side and aligned centrally, so that axis 14 is intercepted by respective sliding axes and axes of symmetry 20 of tappets 12. Tappets 12 may be mechanical types with no slack adjustment, as in the non-limiting example shown, or any known hydraulic type with automatic slack takeup. Whichever the case, each tappet 12 comprises a cylindrical cap 16 coaxial with and sliding along axis 20, and housed inside a guide seat 18 also coaxial with axis 20 and formed in cylinder head 2; and a plate 19 on top of cap 16 and between this and respective cam 11. Cylindrical cap 16 defines the outer body of each tappet 12.

According to the present invention, each stem 13 of valves 5 and 6 presents its longitudinal axis of symmetry 21 offset in relation to axis 20 of respective tappet 12. In particular, axes 20 of tappets 12 are shifted laterally, and alternately on opposite sides, in relation to respective axes 21 of valves 5 and 6, so as to define, in planes IV—IV and V—V perpendicular to axis 14 of camshaft 10, a first eccentricity E1 (FIGS. 1, 4, 5) between each stem 13 and respective tappet 12; so that, when viewed from above (FIG. 1), valve stems 13 are arranged on alternately opposite sides of axis 14; and so that, the center distance E between the stem of intermediate valve 5 and those of the two lateral valves 6, which are aligned in the same plane parallel to plane III—III, i.e. parallel to axis 14, equals the sum of eccentricities E1. As values E1 are preferably equal, center distance E is equal to twice the eccentricity between any two axes 20, 21 relative to the tappet and valve of the same port 7. If necessary, however, timing system 4 may be formed so that eccentricity E1 between the stem axis of valve 5 and the axis of respective tappet 12 differs from (is greater or smaller than) that between the axis of valve 6 and the axis of respective tappet 12.

Figure 3:
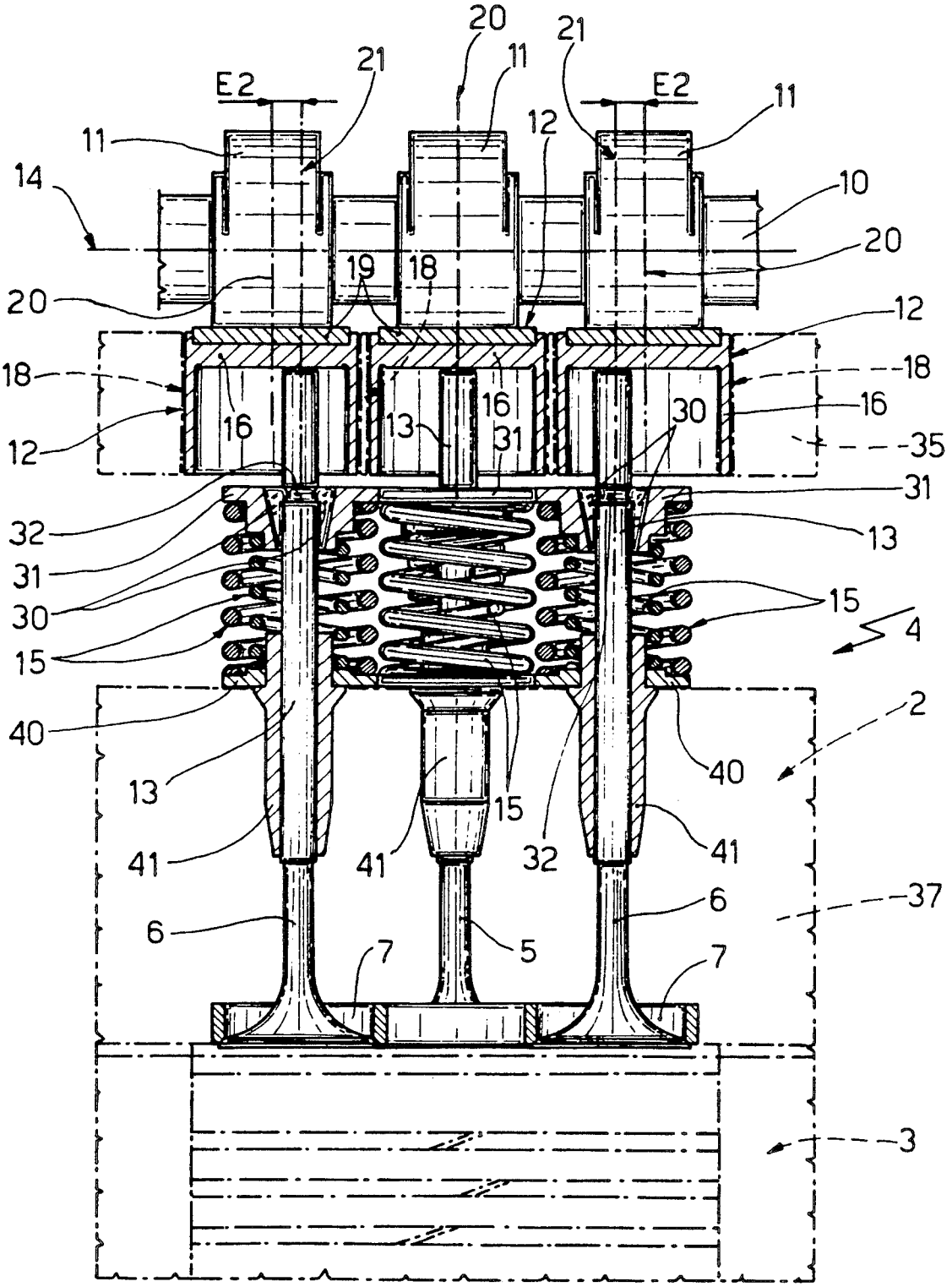
FIGS. 3, 4 and 5 show respective sections along lines III—III, IV—IV and V—V in FIG. 2 of the top portion of an internal combustion engine featuring the timing system according to the present invention.

In conjunction with the foregoing characteristic, the axes of tappets 12 are so arranged that, in the FIG. 3 plane, i.e. in a plane parallel to axis 14, plane III—III and the axis of cylinder 3, stem 13 of intermediate valve 5 is aligned with the axis of respective tappet 12 and, in the example shown, with the axis of cylinder 3, so that, in the FIG. 3 plane, axes 13 and 20 are arranged in line. At the same time, in said plane, stems 13 of lateral valves 6 are both shifted laterally on opposite sides in relation to the axis of respective tappet 12, in particular, towards the stem of intermediate valve 5, so as to define, between each two axes 20 and 21, a second eccentricity E2 (FIGS. 1 and 3) perpendicular to the measuring direction of eccentricities E1.

According to a further characteristic of the present invention, in relation to the axes of respective tappets 12 and to a diametrical plane of cylinder 3 substantially coincident with plane V—V, the stems of lateral valves 6 are arranged specularly symmetrical, so that both eccentricities E2 are specularly equal. Tappets 12 may thus be offset in relation to ports 7 and respective valves 5 and 6 controlling the same, as shown in FIG. 1, thus enabling ports 7 and tappets 12 to be located as required for optimum size and troublefree control: normal-size tappets 12 (instead of small-size ones as on known five-six-valve timing systems) aligned along axis 14; and valves 5 and 6 within the confines of cylinder 3 and in such a position as to enable maximum size of ports 7. Moreover, stems 13 of valves 5 and 6 are all parallel to each other and to the axis of cylinder 3, thus simplifying the design of engine 1 and minimising lateral load on guides 18 despite the relatively high degree of eccentricity between the valve stems and tappets. This also enables the top of the combustion chamber to be formed flat, thus simplifying construction of cylinder head 2.

Figure 4:
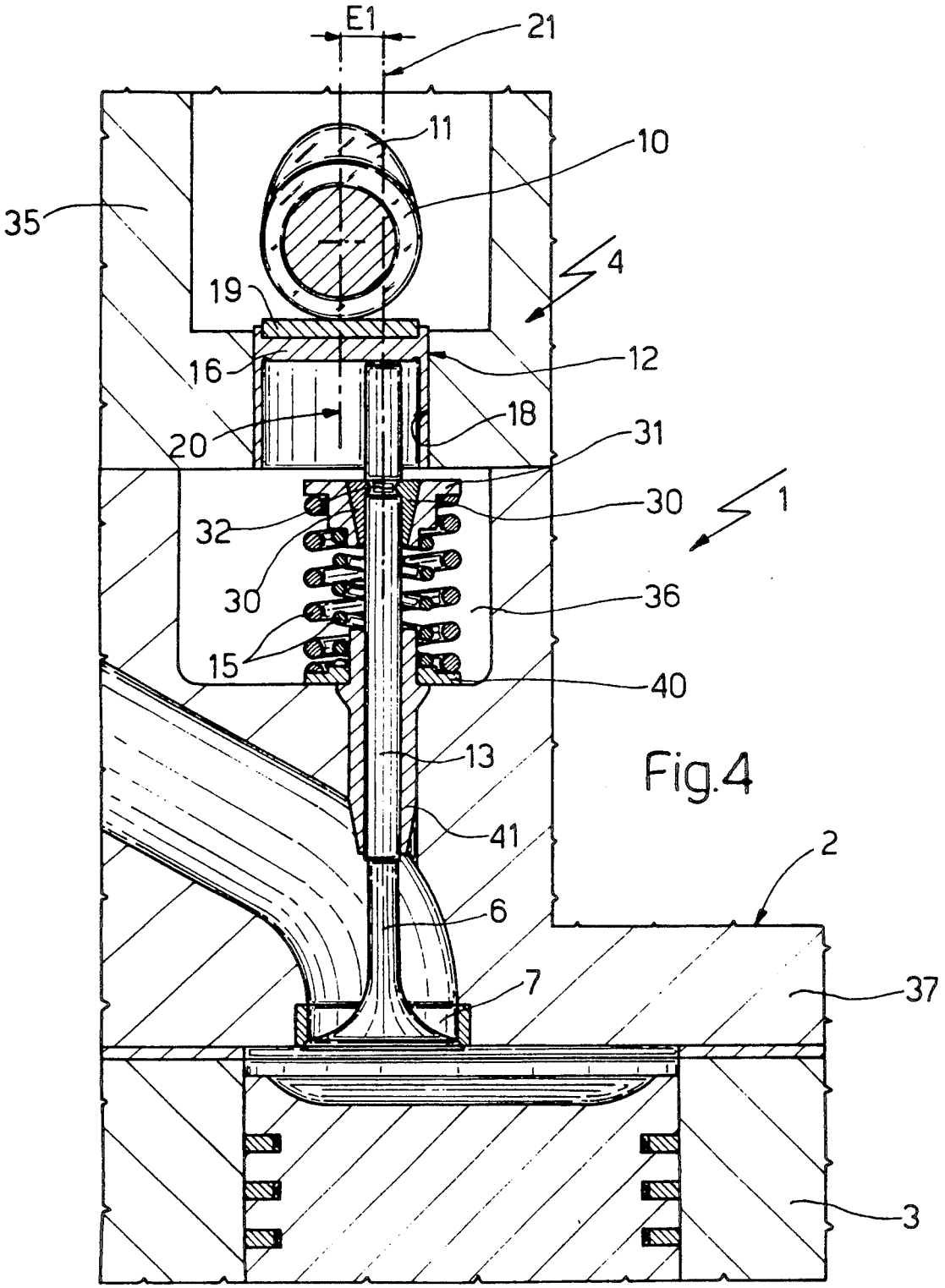
Figure 5:
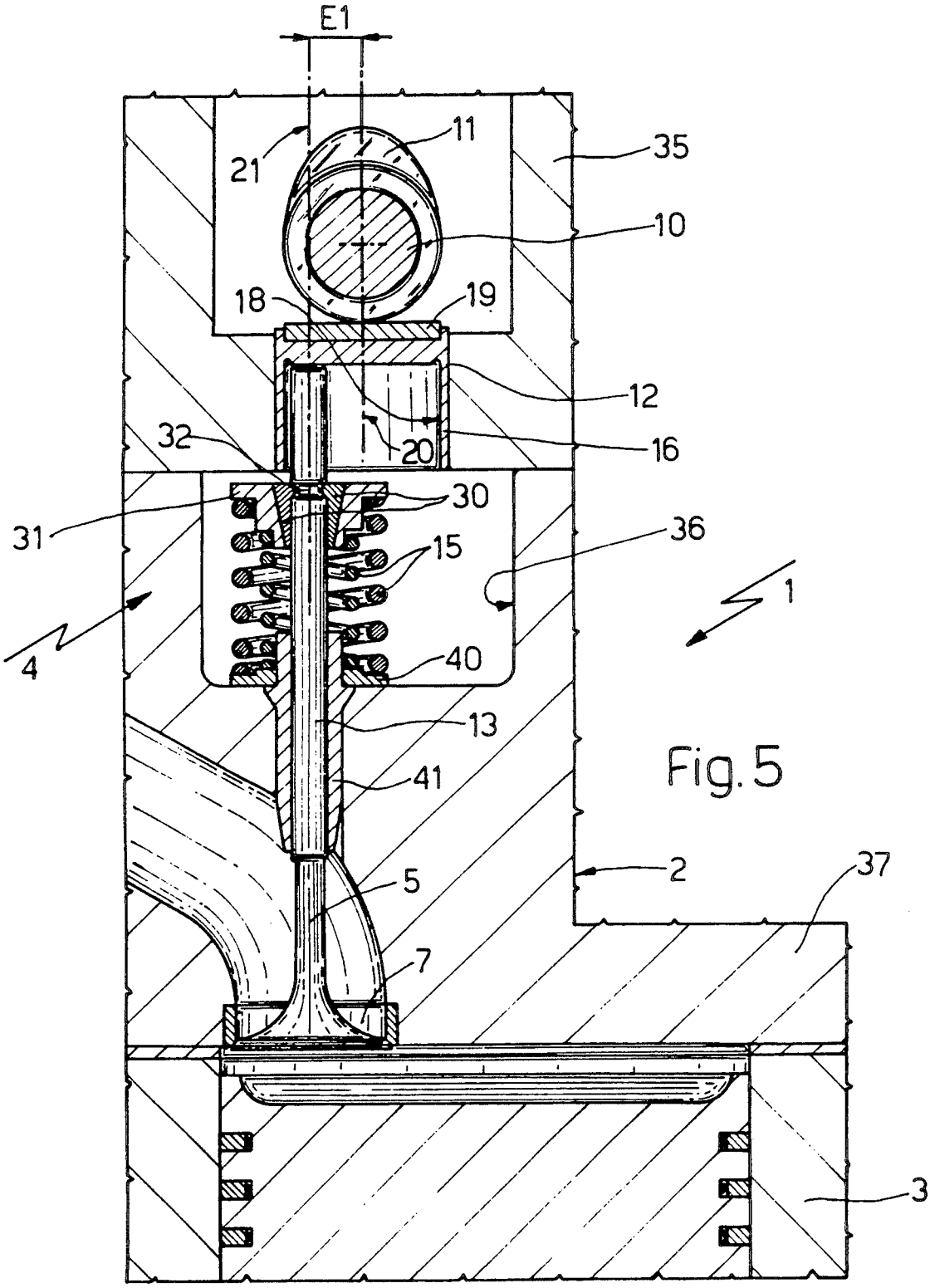
Figure 6:
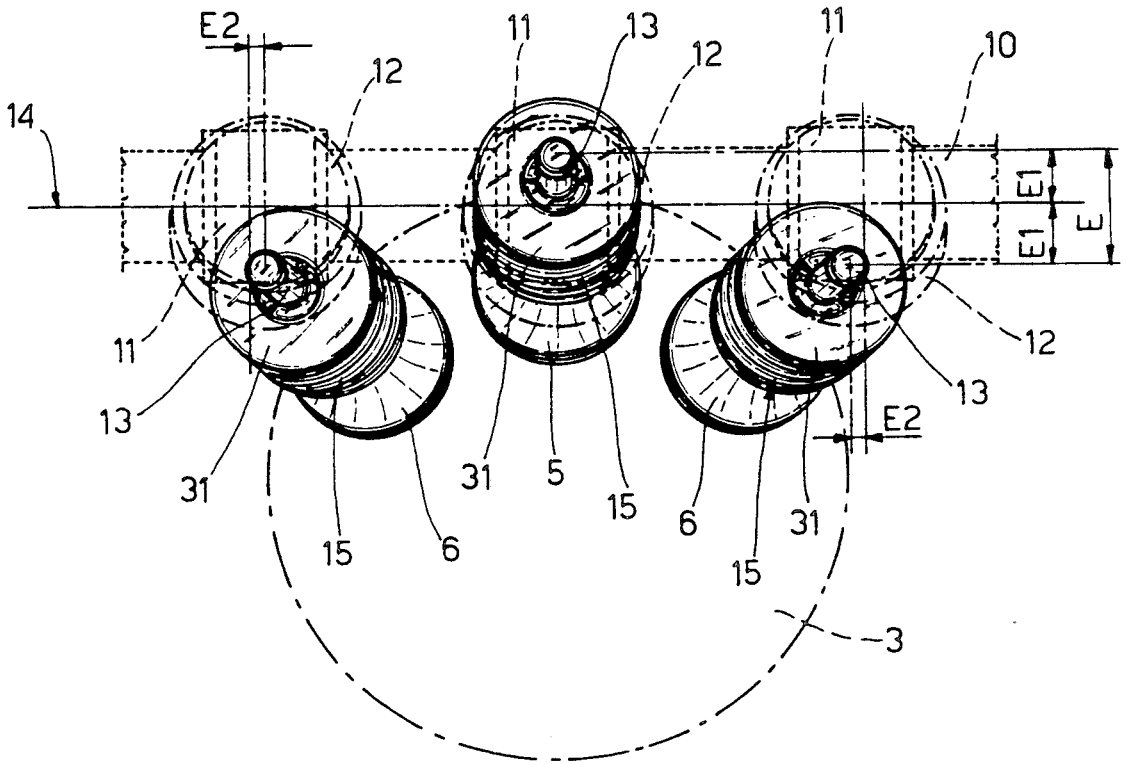
FIG. 6 shows a top plan view of a variation of the timing system according to the present invention.
Figure 7:
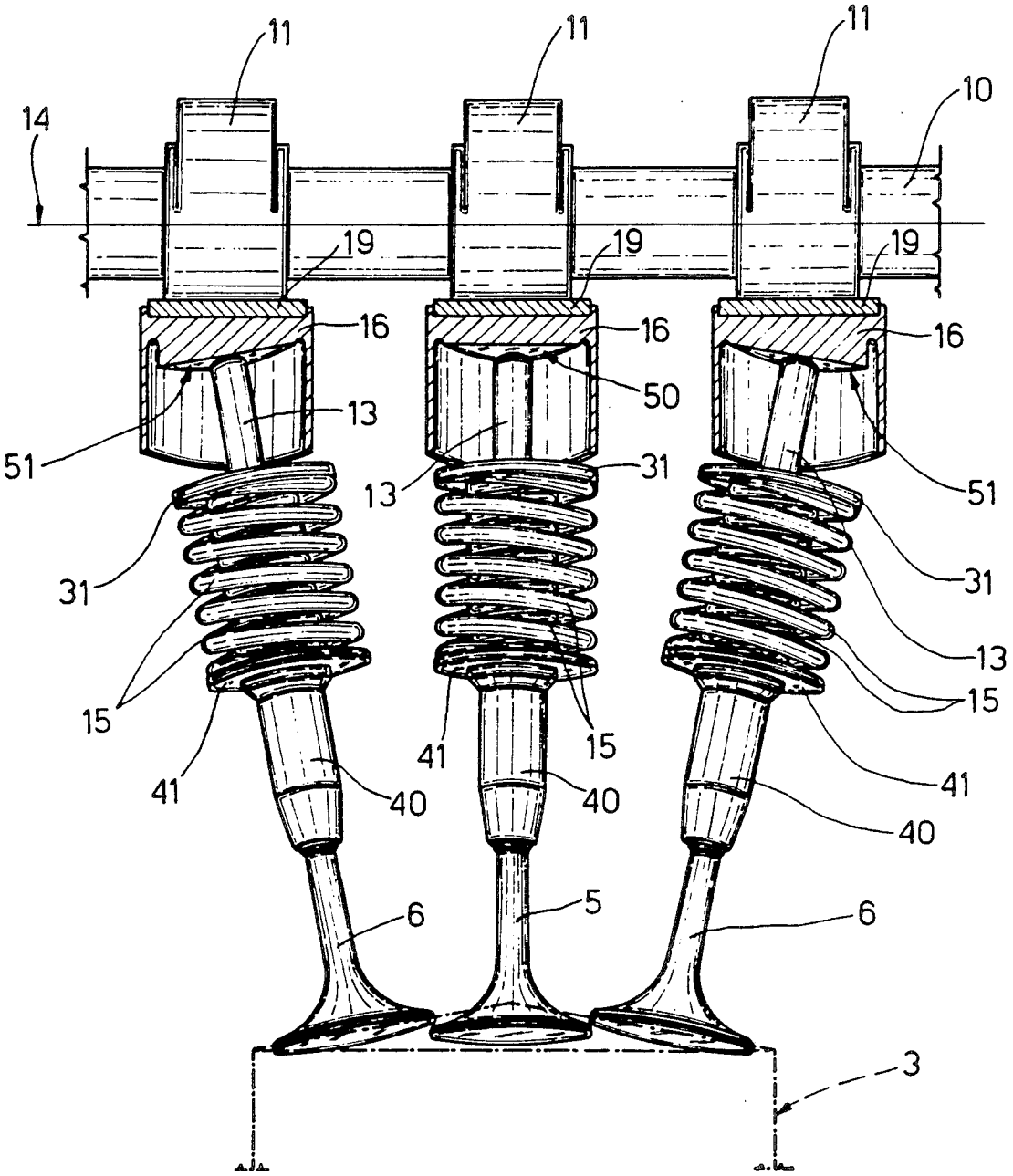
FIGS. 7, 8 and 9 show respective sections along the same lines as in FIG. 2 of the top portion of an internal combustion engine featuring the FIG. 6 variation of the timing system according to the present invention.
Figure 8:
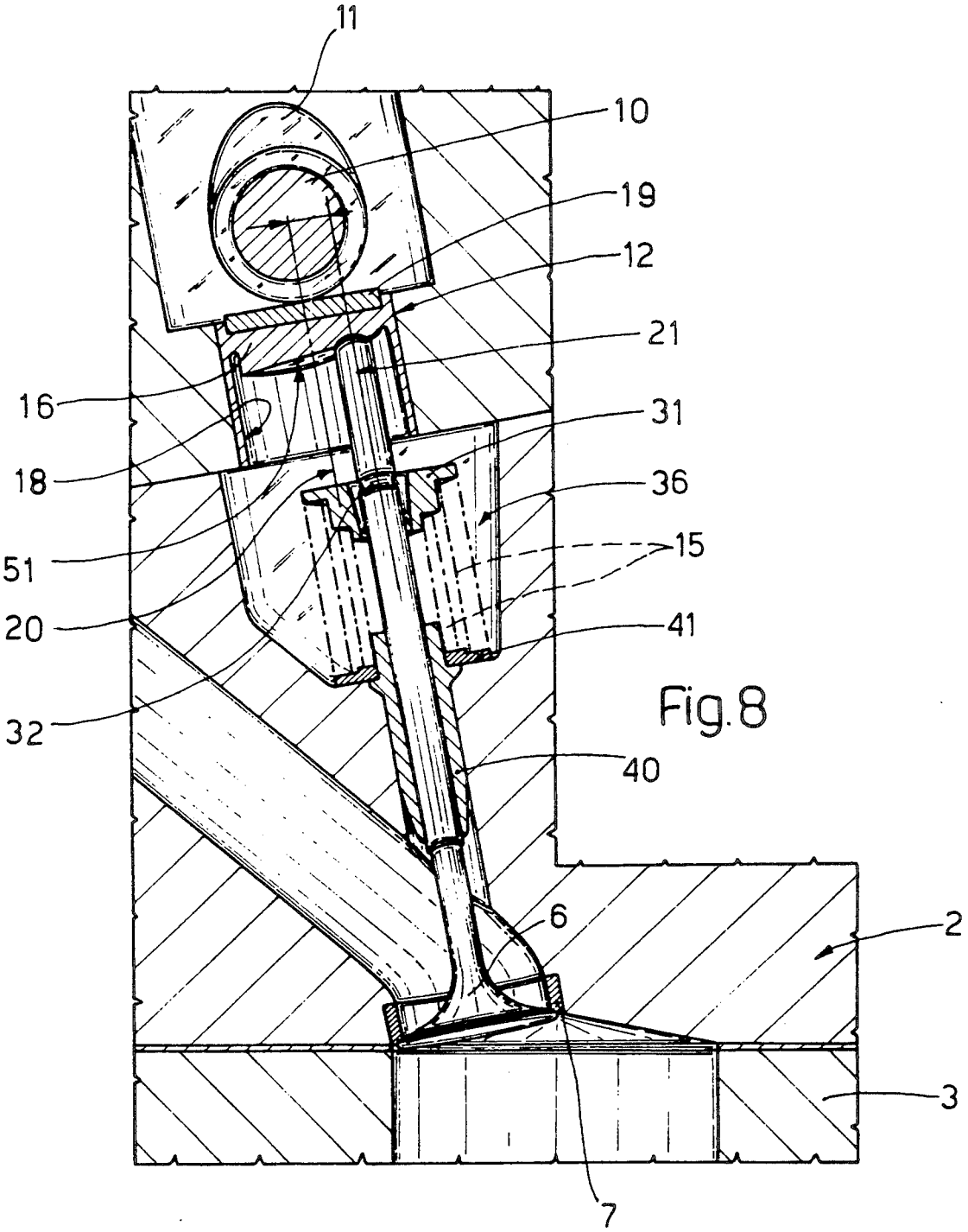
Figure 9:
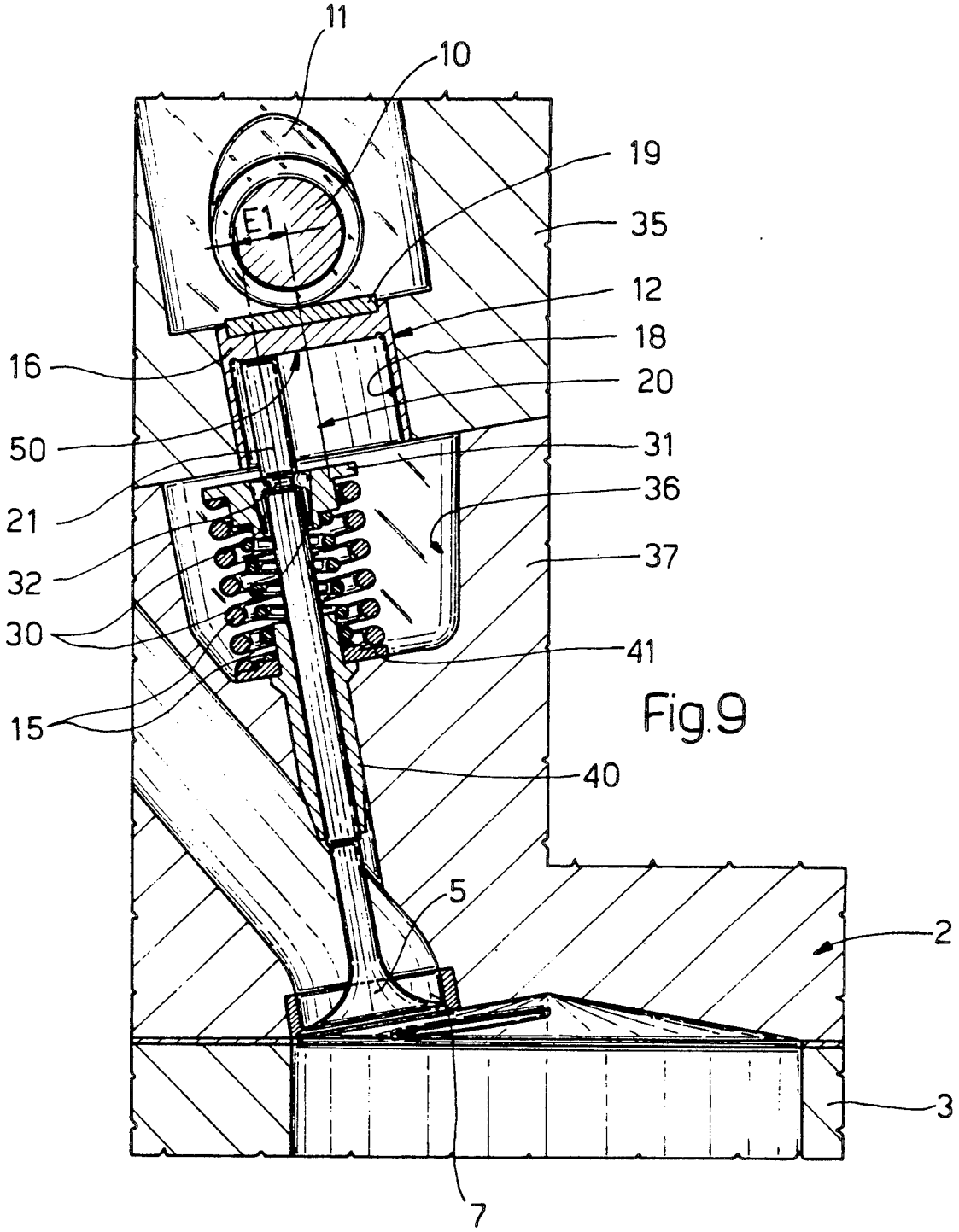

Due to the eccentricity of stems 13 and tappets 12, mechanical control of valves 5 and 6 differs from the traditional system, as shown in FIGS. 3, 4 and 5. In particular, contrast means 15, which consist of respective packs of helical springs wound coaxially about stems 13, are housed entirely outside tappets 12, in the example shown, outside caps 16. In the example shown, springs 15 are mounted between respective shoulders 40, integral with cylinder head 2 and, for example, forming part of respective guides 41 of stems 13, and respective shoulder plates 31, each secured integral with a respective valve stem 13, immediately below respective tappet 12, by means of a pair of known cotters 30 cooperating with a conical inner surface of plate 31 and with a respective groove 32 on valve stem 13. To enable assembly of the above structure, guide seats 10 of tappets 12 are formed in a first portion 35 of cylinder head 2, while springs 15 of each valve 5 and 6 are housed in respective seats 36 fitted through with valve stems 13 and formed beneath guide seats 18 in a second portion 37 of cylinder head 2 fitted on top in releasable known manner with portion 35, according to a scheme known as "castlet type".

With reference to FIGS. 6 to 9 it is shown a further embodiment of the described timing system 4 any details similar or identical to those already described being indicated using the same reference numbers. This variation is used when, for technical reasons, the top of the combustion chamber on the engine is rounded and valves 5 and 6 must therefore be arranged radially, in which case, valve stems 13 are inclined in relation to the axis of respective cylinder 3. In particular, the stems of valves 5 and 6 are arranged obliquely in relation to one another, and cooperate with tappets 12, which though inclined in relation to cylinder 3 are aligned side by side and parallel to one another along the axis of camshaft 10, via oblique supporting surfaces 50 and 51 formed, for example, inside caps 16. In particular, supporting surfaces 51 for the stems of lateral valves 6 are inclined both in relation to the FIG. 7 plane and in relation to the perpendicular FIG. 8 plane, so that they are arranged obliquely in relation to respective valve stems 13. This provides, not only for altering the geometry of the combustion chamber, but also for controlling tappets 12 using a normal camshaft 10 (instead of camshafts with oblique cams 11, as on known radial-valve systems) and further increasing the distance between tappets 12. Furthermore, eccentricities E1 and E2 may be reduced for reducing the lateral load on guides 18. Finally, the inclination of stems 13 is preferably such that the axis of intermediate valve 5 diverges towards axis 14 in relation to the axes of lateral valves 6.

The advantages of the present invention will be clear from the foregoing description. In particular, the doubly offset arrangement, in two perpendicular planes, of the stems of the lateral valves in relation to the tappet axes provides for obtaining a five- or six-valve timing system featuring three large, widely spaced supply and/or exhaust ports (for adequate cooling and safeguarding the cylinder head) despite the three valves being controlled by a single, and what is more, overhead camshaft. This therefore results in a highly efficient, high-performance internal combustion engine timing system, which is both relatively compact and straightforward to produce and assemble. What is more, off-centering of the various valve control components may be fairly small (in the case of radial valves), i.e. may be largely neutralized by maintaining the valve axes parallel to those of the cylinders, thus resulting in very little and, above all, predictable lateral thrust on the guide surfaces of tappets 12, which, if necessary, may be counteracted at the design sage. On engines with known timing systems, on the other hand, wherein spacing of the intake ports depends solely on the degree of inclination of the valves, in-service lateral thrust may be unpredictable and, therefore, far more difficult to counteract.

I claim:

1. A timing system, particularly for an internal combustion engine, whereby a camshaft controls, against the action of elastic means, the translation of respective stems of an intermediate valve and two adjacent lateral service valves, for regulating the input or output of a fluid from a respective cylinder; each said valve being controlled by a respective cam of said camshaft via the interposition of a respective tappet; characterized by the fact that the valve stems are arranged with their axes shifted laterally, and alternately on opposite sides, in relation to a plane including the axes of the tappets, so as to define, between each valve stem and respective tappet, a first eccentricity in a first plane perpendicular to the axis of the camshaft, the stem of said intermediate valve being aligned with the axis of the respective tappet in the first plane; in a second plane perpendicular to said first plane having the stems of the other two valves shifted laterally towards the first plane including the stem of said intermediate valve, so as to define, between the stems and the respective tappets, a second eccentricity perpendicular to said first eccentricity.

2. A timing system as claimed in claim 1, characterised by the fact that the cams on the camshaft cooperate directly with the valve tappets according to an overhead camshaft arrangement; and by the fact that said elastic contrasting means comprise respective helical springs wound about said valve stems and housed entirely outside said tappets; said springs acting on respective shoulder plates, each secured integral with a respective valve stem, immediately below the respective tappet, by means of a pair of cotters cooperating with a conical inner surface of the plate and a respective groove on the valve stem.

3. A timing system as claimed in claim 2, characterised by the fact that said tappets are mechanical, each comprising a cylindrical cap cooperating in sliding manner with a guide seat formed in a first portion of the respective cylinder head; and a plate fitted on top of said cap; said springs of each valve being housed in respective seats fitted through with said valve stems and formed underneath said guide seats in a second portion of said cylinder head fitted on top in releasable manner with said first portion.

4. A system as claimed in claim 3, characterised by the fact that said valve stems are all arranged parallel to one another and to the axis of said cylinder.

5. A system as claimed in claim 3, characterised by the fact that said valve stems are inclined in relation lo the axis of said cylinder, and cooperate with said tappets via oblique supporting surfaces; the oblique surfaces of the lateral valve tappets being doubly inclined, so as to be arranged obliquely in relation to the respective valve stems.

6. A timing system as claimed in claim 1,
characterised by the fact that said tappets are arranged side by side and aligned centrally along the axis of said camshaft; said valve stems being arranged alternately on opposite sides of the axis of said camshaft.

7. A timing system as claimed in claim 1,
characterised by the fact that the stems of said lateral valves are arranged specularly symmetrical in relation to the axes of the respective tappets.

8. A timing system as claimed in claim 1,
characterised by the fact that said first eccentricity is the same for each valve stem and respective tappet.

* * * * *